United States Patent [19]

Braun et al.

[11] Patent Number: 5,063,406

[45] Date of Patent: Nov. 5, 1991

[54] COPYING MACHINE

[75] Inventors: Paul Braun; Ronald W. Kwasniewicz, both of Farmington

[73] Assignee: Kwaun Manufacturing Company, Walled Lake, Mich.

[21] Appl. No.: 122,900

[22] Filed: Nov. 19, 1987

[51] Int. Cl.[5] ..... G03B 27/34

[52] U.S. Cl. ..... 355/57; 355/55; 355/233

[58] Field of Search ..... 355/55, 57, 8, 233

[56] References Cited

U.S. PATENT DOCUMENTS

| | | | |
|---|---|---|---|
| 3,507,576 | 4/1970 | Linde | 355/57 |
| 4,334,762 | 6/1982 | Landa | 355/57 |
| 4,426,149 | 1/1984 | Kuemmel et al. | 355/56 |
| 4,464,046 | 8/1984 | Kanazawa et al. | 355/57 |
| 4,561,758 | 12/1985 | Nawata et al. | 355/8 |

*Primary Examiner*—Monroe H. Hayes

*Attorney, Agent, or Firm*—Reising, Ethington, Barnard, Perry & Milton

[57] ABSTRACT

A copy machine (10) of the type for producing enlargements or reductions of an original material includes mirrors (14) for reflecting an image of the original material to a lens (16) and from the lens (16) to an image fixing system (18), and a lens (16) for enlarging or reducing the image reflected thereto by the mirrors (14). The lens (16) is fixed relative to the machine (10). The image fixing system (18) fixes the reflected image on a substrate. The mirrors (38,40,44,46) are moveable for enlarging or reducing the image reflected to and from the lens (16). The machine (10) includes a control system (20) for controlling the movement of the mirrors (38,40,44,46) and simultaneously reducing or enlarging and focusing the image reflected to the image fixing system (18).

4 Claims, 4 Drawing Sheets

COPYING MACHINE

TECHNICAL FIELD

The present invention relates to copy machines of the type for reproducing a copy of an original material, such by photographic techniques. More specifically, the present invention relates to a copy machine including zoom optics for producing enlargements or reductions of an original material

BACKGROUND ART

State of the art copy machines can include zoom optics for producing enlargement or reductions of an original material. This type of machine generally includes a support surface for the original document and exposure of the original document to an optic system, an optic system for conveying the image of the original, and an image fixing system, such as a conventional electrostatic copying drum for fixing the reflected image of the original onto a substrate, such as piece of paper. The machines including zoom optics include convention feed and fixing systems and include in addition thereto a zoom optic system generally comprising a lens and plurality of mirrors The mirrors reflect the image of the original to the lens which reduces or enlarges the image. Mirrors reflect the altered image to the image fixing system. Some systems require no mirrors while other systems include sophisticated mirror systems. To produce the zoom effect, the lens is carried on a moveable support for moving the lens to focus the image and enlarge or reduce the image. In some systems, some mirrors may move for alignment of the light path carrying the reflected image to the moving lens. An example of such an optic system is the Shacoh 36 distributed by Shacoh U.S.A., Walled Lake, MI.

In order to contain the moving lens through the required distance of movement to effect the zoom process, machines are generally five feet high and ten feet wide. This size machine has a magnification/reduction ratio of 45.8% to 210% through 0.1% increments.

The present invention provides a novel mirror mount and lens mount assembly which provides a zoom optics machine capable of having a magnification/reduction ratio greater than the aforementioned prior art assemblies yet housed with a significantly smaller housing. The present invention further provides a novel support construction for the zoom optic system as a module to allow for easy access to the optic system during assembly or repair.

SUMMARY OF THE INVENTION

In accordance with the present invention, a copy machine is provided of the type for producing enlargements or reductions of an original material, the machine including mirror means for reflecting an image of the original material to a lens and from the lens to an image fixing means, lens means for enlarging or reducing the image reflected thereto by the mirror means, and image fixing means for fixing the reflected image on a substrate. The lens means is fixed relative to the machine. The mirror means is moveable for enlarging or reducing the image reflected to and from the lens means. The machine further includes control means for controlling the movement of the mirror means and simultaneously reducing or enlarging and focusing the image reflected to the image fixing means.

The invention further provides a method of producing an enlarged or reduced copy of a material, the method including the steps of reflecting an image of the original material off of a plurality of mirrors to a fixed lens, enlarging or reducing the image through the fixed lens, and reflecting the image off of a second plurality of mirrors to an image fixing system. Only the mirrors are moved to focus and further enlarge or reduce the image reflected to and from the fixed lens.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
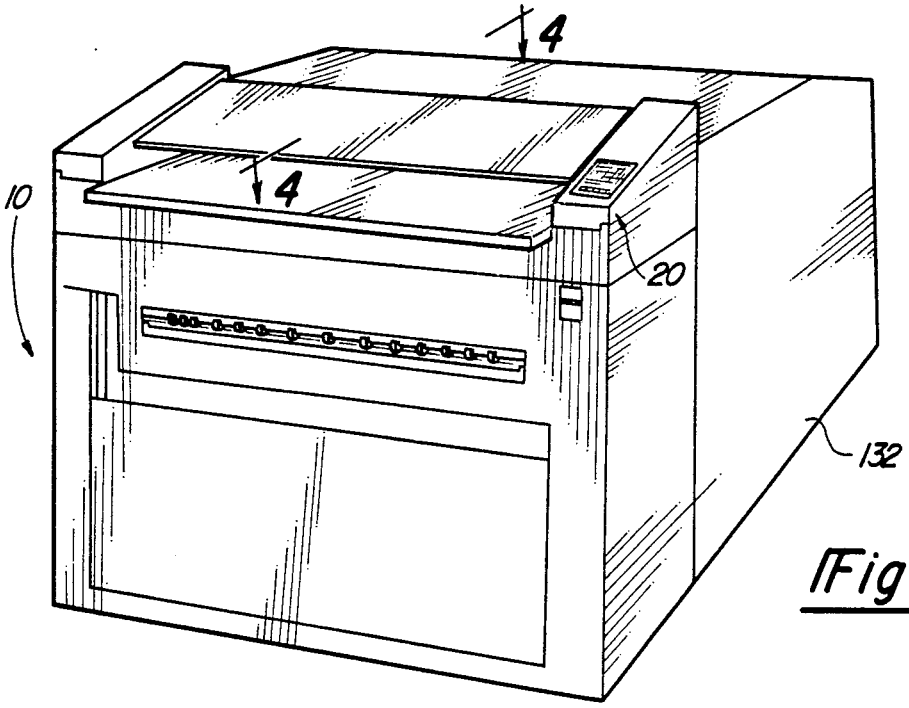
FIG. 1 is a perspective view of a copy machine constructed in accordance with the present invention.
Figure 2:
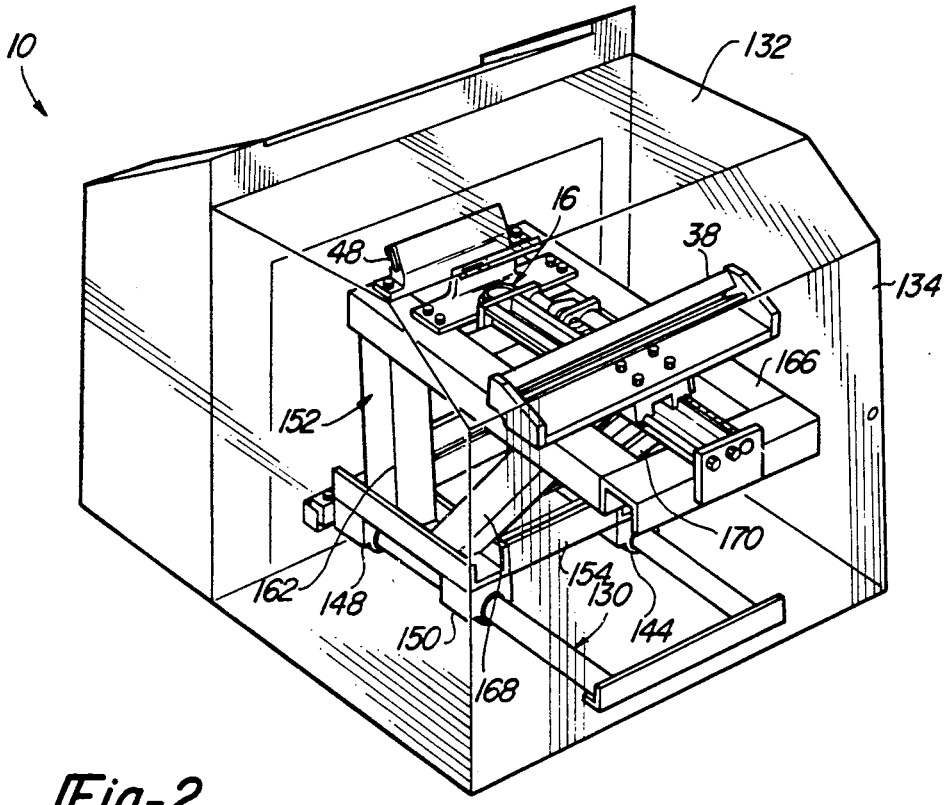
FIG. 2 is a rear perspective view showing the in structure of the optics module.

A copy machine of the type for producing enlargements or reductions of an original material constructed in accordance with the present invention is generally shown at 10 in the Figures.

Generally, the system includes paper feed means generally indicated at 12, zoom optics including mirror means generally indicated at 14 for reflecting an image of the original material to a lens 16 and from the lens 16 to an image fixing system 16, lens means 16 for enlarging or reducing the image reflected thereto by the mirror means 14, and image fixing means 18 for fixing the reflected image on a substrate.

The lens means 16 is fixed relative to the machine 10. The mirror means 14 is moveable for enlarging or reducing the image reflected to and from the lens means 16. The machine 10 includes control means 20 for controlling the movement of the mirror means 14 and simultaneously reducing or enlarging and focusing the image reflected to the image fixing means 18.

Figure 4:
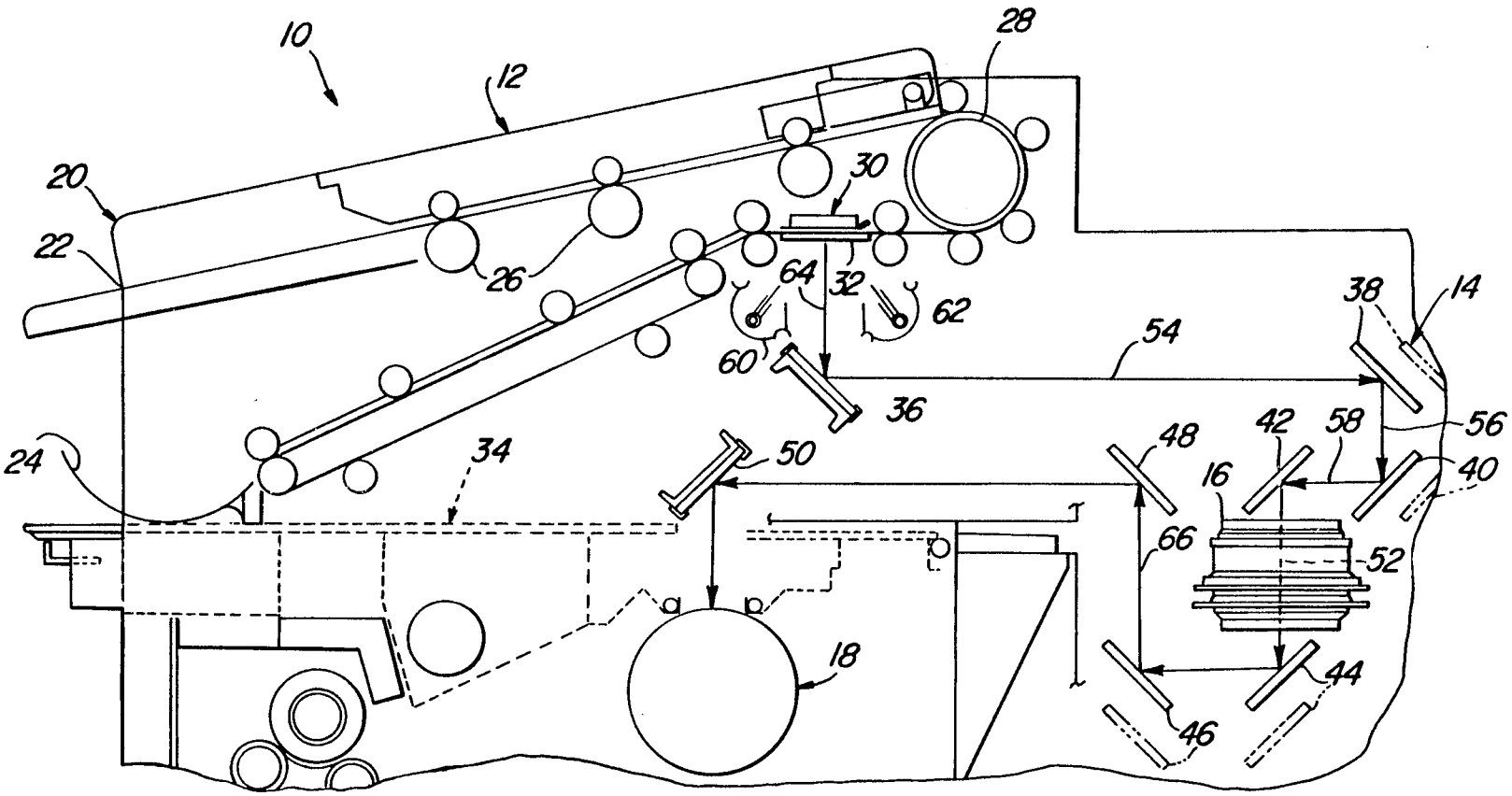
FIG. 4 is schematic fragmentary side elevational view of the internal structure of the present invention.
Figure 5:
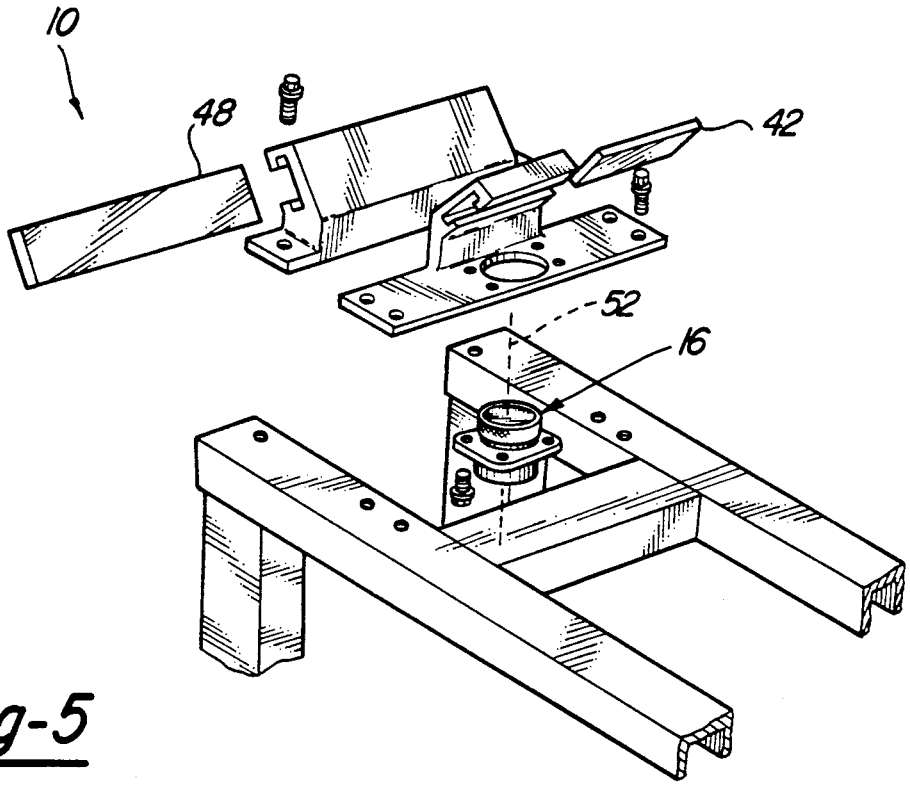
FIG. 5 is perspective fragmentary explode of the lens assembly of the present invention.

More specifically, the paper supply means 12 includes a paper inlet 22 and outlet 24 operatively connected through drive rollers 26 defining a paper feed path for the original material. The original material is in the form of sheets of paper of various sizes. As shown in FIG. 4, the paper feed path travels around a drum 28 which redirects the paper to a photographic area generally indicated at 30 The photographic area includes a glass plate 32 which provides a support surface for the original document to be photographed.

The image fixing means 18 can be a drum for convention electrostatic copying. The drum 18 is part of a lower module generally indicated at 34 for electrostatically copying and processing the image of the original document on a substrate, such as a piece of paper. This portion 34 of the machine 10 includes conventional prior art photographic processing components, such as those found in the model Shacoh 36 distributed by Shacoh U.S.A., Inc. of Walled Lake, Michigan.

The original support surface 32, mirror means 14, lens means 16 and image fixing means 18 define a total path length indicated by arrows in FIG. 4 over which the image of the original material is reflected and focused. The control means 20 is operatively connected to the mirror means 14 to simultaneously move the mirror means 14 to enlarge or reduce the image and change the total path length to focus the enlarged or reduced image on the image fixing means 18 More specifically, the mirror means 14 includes a first plurality of pre-lens mirrors 36,38,40,42 for reflecting the image of the original from the original support surface 32 to the lens 16 and a plurality of post lens mirrors 44,46,48,50 for reflecting the image of the original from the lens 16 to the image fixing means 18. The control means 20 is operatively connected to mirrors 38,40 and 44,46 for coordinating and actuating movement of the mirrors 38,40,44,46.

The lens 16 can be a Nikon Apo-Nikkor lens of the 610 millimeter type.

The lens 16 defines an optical axis 52. The pre-lens mirrors, reflecting light between the original support surface 32 and the lens 16, include a first pair of moveable mirrors 38,40 reflecting an off-axis reflected image from the mirror 36 along a line indicated by the arrow 54, mirror 38 reflecting the image along line 56 to mirror 40 in a direction parallel to the optical axis 52. Mirror 40 reflects the image in a direction perpendicular to the optical axis 52 along line 58 to mirror 42 which then reflects the image along the optical axis 52 through the lens 16. The post lens mirrors include the second pair of moveable mirrors 44,46 reflecting an on-axis reflected image from the optical axis 52, the remaining pre- and post lens mirrors 36,42,48,50 being fixed mirrors reflecting the image to the first pair of moveable mirrors 38,40 and from the first pair of moveable mirrors to the lens 16 and from the second moveable mirrors 44,46 to the image fixing means 18. Each of the mirrors 36,38,40,42,44,46,48,50 are flat mirrors angled at a 45° angle relative to the optical axis 52.

The optical axis 52 is perpendicular to the original support surface 32. The first fixed mirror 36 is below and angled relative to the original support surface 32. Light sources 60,62 are disposed off-axis and below the original support surface 32 for illuminating the original document to be photographed. The first moveable mirror 38 is angled relative to and disposed on line perpendicular to the optical axis 52 relative to the first fixed mirror 36. The second of the first moveable mirrors 40 is angled and disposed on a line parallel to the optical axis 52 relative to the first of the first moveable mirrors 38. The set of pre-lens mirrors includes the second fixed mirror 42 which is on and angled relative to the optical axis 52 and on a line perpendicular to the optical axis 52 relative to the second of the first moveable mirrors 40. A first of the second moveable mirrors 44 is on and angled relative to the optical axis 52. The second of the second moveable mirrors 46 is angled and on-line perpendicular to the optical axis 52 relative to the first of the second moveable mirrors 44. The post lens mirrors further include the third fixed mirror 48 angled relative to an on line parallel to the optical axis 52 relative to the second of the second moveable mirrors 46. The fourth fixed mirror 50 is angled relative to and on line perpendicular to the optical axis 52 relative to the third fixed mirror 48. The fourth fixed mirror 50 is also on a line parallel to the image fixing means 18.

Functionally, fixed mirror 36 reflects the light rays shown as arrow 64 and reflects the rays to the first of the moveable mirrors 38. The fixed mirror 42 reflects light from the second of the moveable mirrors 40 to the optical axis 52 and through the lens 16. The third fixed mirror 48 and fourth fixed mirror 50 combine to direct the reflected light beam 66 from the second of the moveable mirrors 46 to the image fixing means 18.

The first moveable mirrors 38,40 are moveable, as indicated by hatched lines, in a direction perpendicular relative to the optical axis 52. The second moveable mirrors 44,46 are moveable, as indicated in hatch lines, in a vertical direction parallel relative to the optical axis 52. As the first set of moveable mirrors 38,40 move in a direction towards the lens 16, the image reflected by the first moveable mirrors 38,40 is enlarged thereby presenting an enlarged image to the lens 16. As the first moveable mirrors 38,40 move in the opposite direction, away from the lens 16, the image reflected to the lens 16 is reduced. Thusly, the moveable mirrors 38,40 cooperate with the lens 16 to further enlarge or reduce the image reflected to the lens 16.

The second set of moveable mirrors 44,46 are moved in coordination with the first set of moveable mirrors 38,40 by the control means 20. The control means 20 can be a programmable software system for actuating movement of the first and second moveable mirrors 38,40,44,46 for changing the focal path distance to move the focal point of the reflected image relative to the lens 52 to thereby focus the image, enlarged or reduced, on the image fixing means 18. The movement of the first and second moveable lens mirrors 38,40,44,46 are coordinated and not necessarily equal in distance relative to the lens. The second moveable mirrors 44,46 may be moved a greater or lesser distance than first moveable mirrors 38,40 to adjust the focal path distance in order to focus the image of the original document on the image fixing means 18.

The following chart illustrates the magnification/reduction ratio between 40% and 150% showing the path length in millimeters of the prelens path length and post lens path length and total path length values.

| PER-CENT | PRELENS FOCAL PATH LENGTH MM | POST LENS FOCAL PATH LENGTH IN MM | TOTAL FOCAL PATH LENGTH |
|---|---|---|---|
| 40 | 2135 | 854 | 2989 |
| 50 | 1830 | 915 | 2745 |
| 60 | 1626.6 | 976 | 2602.6 |
| 66.6 | 1525 | 1016.87 | 2541.8 |
| 70 | 1481.4 | 1037 | 2518.4 |
| 80 | 1372.5 | 1098 | 2470.5 |
| 85.7 | 1321.8 | 1132.8 | 2454.6 |
| 90 | 1287.8 | 1159 | 2446.8 |
| 100 | 1220 | 1220 | 2440 |
| 110 | 1164.5 | 1281 | 2445.5 |
| 120 | 1118.3 | 1342 | 2460.3 |
| 130 | 1079.2 | 1403 | 2482.2 |
| 140 | 1045.7 | 1464 | 2509.7 |
| 150 | 1016.6 | 1525 | 2541.6 |

The above chart shows that over a range of reproduction from 40% to 150%, the path length changes from a maximum of 2989 mm to a minimum of 2440 mm at unity. Such a machine can produce an enlargement of 250% utilizing the same total path length of 2989 mm. This is significantly smaller than prior art systems having comparable enlargement and reduction capabilities.

Figure 3:
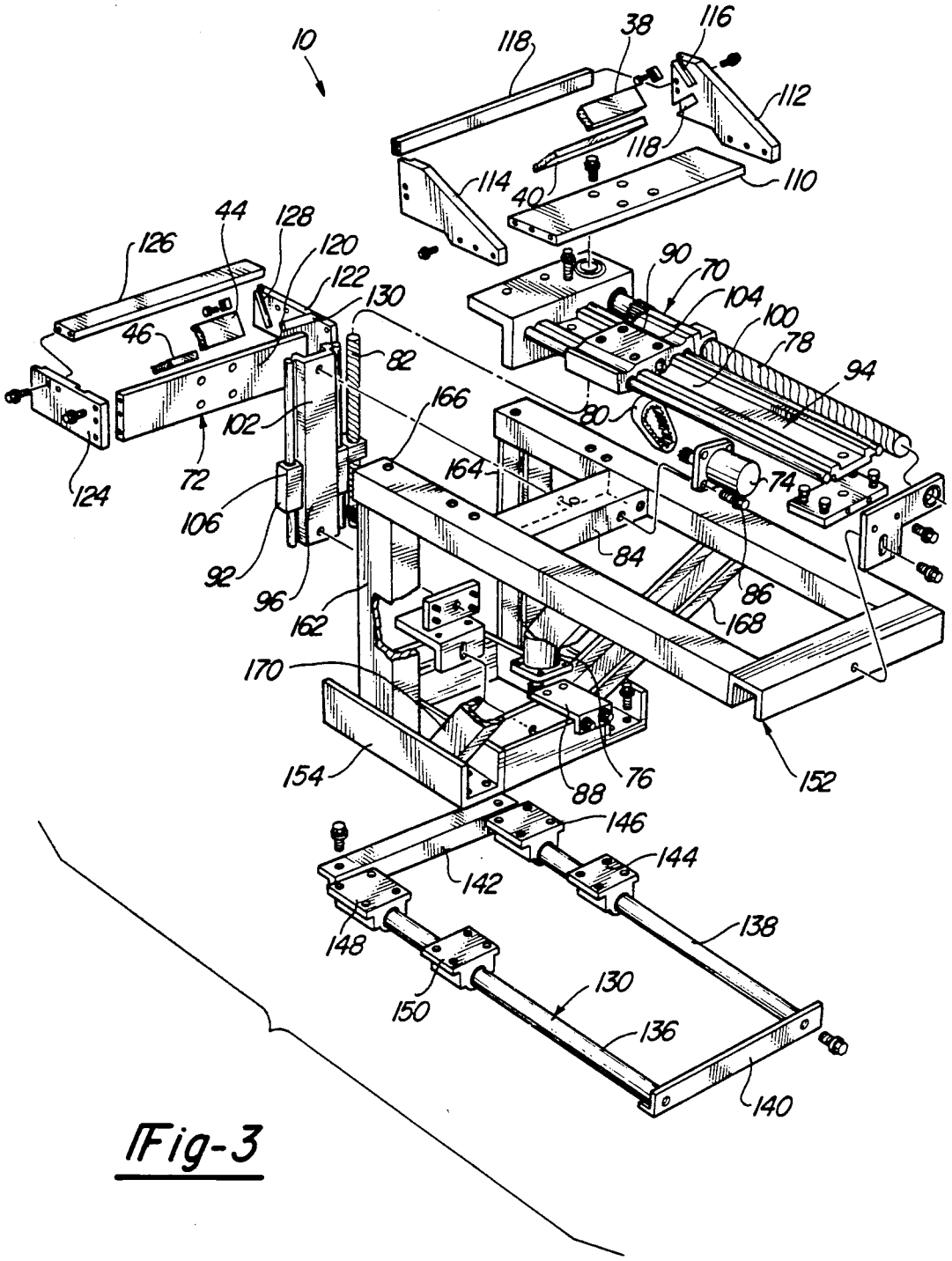
FIG. 3 is perspective exploded view of the optics module.

The machine 10 further includes a pair of moveable mirror support means generally indicated at 70,72 in FIG. 3, each of the mirror support means 70,72 supporting one pair of the moveable mirrors 38,40,44,46 for simultaneous movement. The control means 20 includes drive means and driven means operatively connected to the drive means for indexing each of the mirror support means 70,72. More specifically, the drive means includes a stepper motor 74 for actuating movement of the first pair of moveable mirrors 38,40 and a second stepper motor 76 for driving movement of the second pair of moveable mirrors 44,46. The driven means includes a first worm gear 78 operatively connected to the stepper motor 74 by a belt 80. Worm gear 82 is operatively connected to stepper motor 76 by a similar belt, not shown in the drawings. Motor 74 is fixedly secured to support bracket 84 by fasteners 86 and motor 76 is connected to support bracket 88 by fasteners not shown.

The mirror support means 70,72 includes platforms 90,92 threadedly connected to worm gears 78,82 and anti-rotation means 94,96 for preventing rotation of the platforms 90,92 respectively relative to the worm gears 78,82. The anti-rotation means 94,96 are conventional linear motion system guides, such as those manufactured by Thompson Industries, Inc. of Port Washington, New York. The guide systems include a dual shaft track system 100,102 and a dual axis linear bearing system 104,106 which rides on the tracks The structure provides that rotation of the worm gears 78,82 moves the platforms 90,92 respectively, along the length of the worm gears 78,82.

In operation, movement of the mirrors 38,40 are controlled through the control means 20 by actuation of the stepper motor 74. The stepper motor 74 drives the worm gear 78 through belt 80 thereby moving the platform 90 and mirrors 38,40 operatively connected thereto. The mirrors 38,40 are supported by a housing including a bottom wall 110 and side walls 112,114. The mirrors 38,40 are supported in slots 116,118 in the side walls 112,114. Member 118 blocks unnecessary light and glare and is mounted between the two mirrors 38,40. In a similar fashion, stepper motor 76 drives worm gear 82 to move mirrors 44,46. Mirrors 44,46 are mounted in a housing comprising a bottom wall 120 and side walls 122,124. Member 126 blocks unnecessary light and glare and is mounted between mirrors 44,46. Mirrors 44,46 are mounted in slots 128,130 formed in the side walls 122,124.

The moveable mirrors 38,40,44,46 and lens 16 are supported as a module slideably on a track generally indicated at 130 for sliding extension from and retraction back into the machine housing 132. More specifically, the rear wall !34 of the housing is removable. The track 130 includes two parallel supports 136,138 joined by cross members 140,142. Bearing supports 144,146,148,150 are mounted for sliding movement on the supports 136,138. The bearing supports 144,146,148,150 support a support frame generally indicated at 152.

The frame 152 includes a lower platform 154 connected to the bearing members 144,146,148,150. A first pair of vertically extending support beams 162,164 extend upwardly from the lower platform 154 and have ends connected to an upper platform 166. A pair of spaced substantially vertical beams 168,170 are mounted between the lower platform 154 and upper platform 166. The upper platform 152 supports the first pair of moveable mirrors 38,40 for horizontal movement The vertical beams 162 support the second moveable mirrors 44,46 for vertical movement. The angled vertical beams 168,170 support the length of the upper platform 166.

The combination of the moveable mirrors, one pair of moveable mirrors 38,40 being offset from the optical axis 52, in combination with the structure of the support frame 152, provides a compact optical system for the copy machine 10. The optical system, including the moveable mirrors 38,40,44,46 in combination with the lens 16, is supported on the support frame 152 as a module. The entire module can be removed in a sliding manner from the housing 132 by opening the rear 134 of the housing sliding the entire support frame module 152 along the tracks 130 to remove the entire optical module from the internal aspects of the housing 132. Any adjustments, manipulations, or repairs can be made to the optical module with easy access to the entire assembly.

The present invention further provides a method for producing the enlarged or reduced copy of the original material. The method includes the steps of reflecting the image of the original material off of the plurality of mirrors 36,38,40,42 to the fixed lens 16 and enlarging or reducing the image through the fixed lens 16. The image is then reflected off of the second plurality of mirrors 44,46,48,50 to the image fixing system 18. Only the mirrors 38,40,44,46 move to focus and further enlarge or reduce the image reflected to and from the fixed lens 16. More specifically, the mirrors 14 and lens 16 define a focal path between the original material and the image fixing system 18. The pair of mirrors 38,40 on the focal path between the original material and the lens 16 are moved away from the lens to enlarge the image and towards the lens to reduce the image while simultaneously moving the pair of mirrors 44,46 on the focal path between the lens 16 and image fixing system 18 for changing the total distance of the focal path to focus the image of the original on the image fixing system 18.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A copy machine comprising: a housing (134); original document support means (32) for supporting an original document to be copied; mirror and lens means (14,16) for reflecting and focusing an image from said support means (32) to an image fixing means (18); image fixing means (18) for fixing the reflected image on a substrate; and characterized by including a slide track (13) within said housing (134) and mirror and lens support means mounted in said track (14,16) for supporting said mirror (14) and lens means (16) as a module slideably on said track (130) for sliding extension from and retraction back into said housing to expose said entire module outside of said housing.

2. A machine as set forth in claim 1 further characterized by said mirror and lens support means including a support frame (102), said guide track (130) fixedly secured relative to said housing and bearing connector members (144,146,148,150) connecting said frame (152) to said guide track (130).

3. A machine as set forth in claim 2 further characterized by said frame including a lower platform (154) connected to said bearing connector members (144,146,148,150), a first pair of spaced vertical support beams (162,164) and a pair of spaced substantially vertically angled support beams (168,170) mounted on said lower platform (154), and an upper platform (166) mounted on the ends of said beams (162,164,168,170), said upper platform (152) supporting said mirror means (14) for horizontal movement and said vertical beams supporting said mirror means (14) for vertical movement and said angled vertical beams (168,170) supporting the length of said upper platform (166).

4. A copy machine (10) of the type for producing enlargements or reductions of an original material, said machine (10) comprising: mirror means (14) for reflecting an image of the original material to a lens (16) and from the lens (16) to an image fixing means (18); lens means (16) for enlarging or reducing the image reflected thereto by said mirror means (14); image fixing means (18) for fixing the reflected image on a substrate, said lens means (16) being fixed relative to said machine (10), said mirror means (14) being moveable for enlarging or reducing the image reflected to and from said lens means (16); control means (20) for controlling the movement of said mirror means (14) and simultaneously reducing or enlarging and focusing the image reflected to said image fixing means (18); an original support surface (32), said mirror means (14) including a first plurality of pre-lens mirrors (36,38,40,42) for reflecting the image of the original from said original support surface (32) to said lens means (16) and a plurality of post-lens mirrors (44,46,48,50) for reflecting the image of the original from said lens (16) to said image fixing means (18), said original support surface (32), mirror means (14), lens means (16), and image fixing means (18) defining a total path length over which the image is reflected and focused; a pair of moveable mirror support means (70,72) each of said mirror support means (70,72) supporting one pair of said moveable mirrors (38,40,44,46) for simultaneous movement, said control means (20) for each of said mirror support means including a stepper motor (74,76) and a worm gear (78,82) operatively connected to and driven by said motor (74), each of said mirror support means (70,72) including a platform (90,92) threadedly connected to said worm gear (78,82) and anti-rotation means (94,96) for preventing rotation of said platform (90,92) relative to said worm gear (78,82) whereby rotation of said worm gear (78,82) moves said platform (90,92) along the length of said worm gear (78,82), said control means (20) including a programmable system for actuating movement of each of said stepper motors (74,76) and coordinating changes in the path length of travel of the reflected image to focus the image on said image fixing means (18) as the image is enlarged or reduced; including a slide track (13) within said housing (134) and mirror and lens support means (14,16) mounted on said track for supporting said mirror (14) and lens means (16) as a module slideably on said track (130) for sliding extension from and retraction back into said housing to expose said entire module outside of said housing.

* * * * *